United States Patent [19]

Dickerson et al.

[11] 3,996,940

[45] Dec. 14, 1976

[54] TOBACCO PRODUCT

[75] Inventors: James P. Dickerson; Donald L. Roberts, both of Winston-Salem, N.C.

[73] Assignee: R. J. Reynolds Tobacco Company, Winston-Salem, N.C.

[22] Filed: Apr. 8, 1975

[21] Appl. No.: 566,083

[52] U.S. Cl. ..... 131/17 R; 131/144

[51] Int. Cl.[2] ..... A24B 3/12

[58] Field of Search ..... 131/2, 17, 140–144; 426/534, 536, 537, 538

[56] References Cited

UNITED STATES PATENTS 3,334,637 8/1967 Roberts et al. ..... 131/17 X 3,529,607 9/1970 Luttich ..... 131/144

OTHER PUBLICATIONS

"Dangerous Prop. of Indust. Mat." by Sax, 3rd Edit. Reinhold Book Corp. 1969, p. 1069 of Sax.

*Primary Examiner*—Robert W. Michell
*Assistant Examiner*—V. Millin
*Attorney, Agent, or Firm*—Neuman, Williams, Anderson & Olson

[57] ABSTRACT

Addition of substituted pyrrole compounds to tobacco to enhance the flavor and/or aroma thereof.

5 Claims, No Drawings

TOBACCO PRODUCT

This invention relates to tobacco and tobacco products and has for an object the provision of compositions and processes for improving the flavor and/or aroma of tobacco and tobacco smoke.

It is well known in the tobacco art that the flavor and aroma of tobacco products and the smoke from the tobacco are very important considerations insofar as the ultimate consumer is concerned. Considerable efforts are exerted by the manufacturers of tobacco products to provide a product that will be acceptable to the consumer, particularly as regards flavor and aroma characteristics. It has been the common practice in the tobacco industry to prepare blends of domestic and oriental tobaccos in order to provide smoking tobacco which has a pleasing flavor and aroma before and during smoking. However, such a procedure is costly and may at times become prohibitive in the event that certain types of tobacco may be in short supply. Accordingly, it is a further object of this invention to provide a class of additive materials which when applied to the tobacco products improve and enhance the flavor and aroma of these products and the smoke emitted therefrom thereby increasing or enhancing the pleasure and other values that may be derived by the consumer from the use of these products.

A further object of this invention is the provision of processes for enhancing or otherwise improving the flavor, aroma and other qualities of certain domestic, oriental, reconstituted or synthetic tobaccos which may be deficient in said flavor or aroma or other qualities.

A still further object of this invention is the provision of smoking products, such as cigarettes, cigars or pipe tobacco, and a process for forming same whereby the flavor and aroma before and during smoking are improved or enhanced.

Further and additional objects will appear from the following description and the appended claims.

In accordance with this invention, the flavor and/or aroma of tobacco products is improved by adding thereto a small amount of a compound having the following general formula:

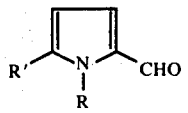

wherein R is a carboxyalkyl group containing from 2 to 8 carbon atoms and R′ is hydrogen or an alkyl group of 1 to 4 carbon atoms.

Representative of the substituted pyrrole tobacco additives of this invention are: 2-(2-formylpyrrol-1-yl)propionic acid, 2-(2-formylpyrrol-1-yl)-3-methylbutyric acid, 2-(2-formylpyrrol-1-yl)-4-methylvaleric acid, 2-(2-formylpyrrol-1-yl)-3-methylvaleric acid, 2-(2-formylpyrrol-1-yl)caprylic acid, 3-(2-formylpyrrol-1-yl)butyric acid, 3-(2-formylpyrrol-1-yl)valeric acid, 4-(2-formylpyrrol-1-yl)butyric acid, 4-(2-formylpyrrol-1-yl)valeric acid, 6-(2-formylpyrrol-1-yl)caproic acid, 8-(2-formylpyrrol-1-yl)caprylic acid, 2-(2-formyl-5-methylpyrrol-1-yl)propionic acid, 2-(2-formyl-5-ethylpyrrol-1-yl)-4-methylvaleric acid, 4-(2-formyl-5-methylpyrrol-1-yl)-butyric acid and 8-(2-formyl-5-butylpyrrol-1-yl)caprylic acid.

The tobacco additives of this invention, some of which have been isolated from flue-cured tobacco, can be prepared by reacting the sodium salt of an appropriate pyrrole carboxyaldehyde with an appropriate ester of a bromo-substituted carboxylic acid. The reaction can be generally illustrated as follows:

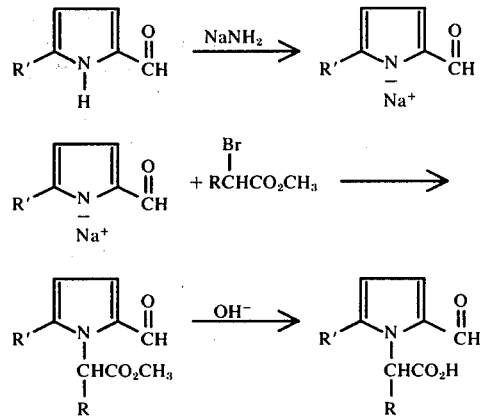

The above synthesis is specifically exemplified by the preparation of 2-(2-formylpyrrol-1-yl)-4-methylvaleric acid as follows:

To 8.4 grams of a 57% oil dispersion (0.2 mole) of sodium hydride suspended in 350 milliliters of toluene was added 19 grams (0.2 mole) of pyrrole-2-carboxaldehyde. The resulting mixture was refluxed overnight under a nitrogen atmosphere. A solution of 41 grams (0.2 mole) of methyl 2-bromo-4-methylvalerate in 200 milliliters of toluene was then added dropwise to the pyrrole-2-carboxyaldehyde salt suspension and the resulting reaction mixture was maintained at 70°–80° C. for 7 days. Water was then added to the reaction mixture and the toluene layer was separated which contained methyl 2-(2-formylpyrrol-1-yl)-4-methylvalerate. Acidification of the aqueous layer obtained from the reaction mixture followed by solvent extraction resulted in the isolation of 12.2 grams of acidic material which was identified as 2-(2-formylpyrrol-1-yl)-4-methylvaleric acid on the basis of nuclear magnetic resonance and infrared spectral data. Infrared data (cm.$^{-1}$): 2780, 2720, 2520 (broad), 1720, 1654, 1528, 1370, 1216 and 756. Nuclear magnetic resonance data: δ 10.88 (-$CO_2$H), 9.38 (-CHO), 7.25 (-CH=C), 6.95 (-CH=C), 6.28 (-CH=C), 6.0 ($CH_2$CH-$CO_2$H), 2.0 (-$CH_2$-), 1.40 ($CH_3$-CH-$CH_3$), and 0.90 ($CH_3$-CH-$CH_3$).

In practice of this invention, a compound of the class described or mixtures thereof is added to tobacco or applied to a tobacco product or its component parts in amounts of from about 0.0005 to about 1.0 percent by weight of the tobacco or tobacco product. preferably the amount of additive is between about 0.001 and 0.1 percent by weight. However, the amount used will depend upon the amount of flavor and/or aroma desired and the particular compound or mixtures thereof that is used. The additives can be incorporated at any step in treatment of the tobacco but are preferably added after aging, curing and shredding and before the tobacco is formed into cigarettes or other products. Likewise, it will be apparent that only a portion of the tobacco need be treated and the thus treated tobacco can be blended with other tobaccos before the cigarettes or other tobacco products are formed. In such case the treated tobacco may have the additive in excess of the amounts above indicated so that when blended with other tobaccos the final product will contain a percentage of additive within the indicated range.

The tobacco additives of the invention, when incorporated into tobacco products, improve the flavor and/or aroma of the product. However, it is to be appreciated that definition or characterization of flavor or aroma in the tobacco art is almost purely subjective and different smokers may define the same flavor or effect quite differently. With this in mind, characterization of the effect of representative tobacco additives of this invention in cigarettes has been made as follows:

| Additive | Flavor Evaluation |
|---|---|
| 2-(2-formylpyrrol-1-yl)-4-methylvaleric acid | Smooth, sweet, nutty |
| 2-(2-formylpyrrol-1-yl)-3-methylvaleric acid | soapy, sweet, slightly floral and fruity |

In accordance with one specific embodiment of this invention, an aged flue-cured and shredded tobacco is sprayed with a 1 percent ethyl alcohol solution of 2-(2-formylpyrrol-1-yl)propionic acid in an amount to provide a tobacco containing 0.05 percent by weight of the additive on a dry basis. Thereafter the alcohol is removed by evaporation and the tobacco is manufactured into cigarettes by the usual techniques. The cigarette when prepared as indicated has an improved character when smoked.

The additives falling within the scope of this invention may be applied to the tobacco by spraying, dipping or otherwise, utilizing suitable suspensions or solutions of the additives. Thus, water or volatile organic solvents, such as alcohol, ether, acetone, volatile hydrocarbons and the like, may be used as the carrying medium for the additives while being applied to the tobacco. Also, other flavor- and aroma-producing additives, such as those disclosed in U.S. pats. Nos. 2,766,145, 2,905,575, 2,905,576, 2,978,365 and 3,041,211 may be incorporated into the tobacco with the additives of this invention.

While this invention is principally useful in the manufacture of cigarette tobacco, it is also suitable for use in connection with the manufacture of pipe tobacco, cigars or other tobacco products. Furthermore, the additives can be added to certain tobacco substitutes of natural or synthetic origin and by the term "tobacco" as used throughout this specification is meant any composition intended for use by smoking or otherwise, whether composed of tobacco plant parts or substitute materials or both.

Also, the invention has been particularly described with reference to the addition of the additives directly to tobacco. However, it will be apparent that the additives can be applied to the paper of the cigarette or to the wrapper of a cigar. Also, they can be incorporated into the filter tip, the packaging material or the seam paste employed for gluing the cigarette paper. Thus, a tobacco product is provided which includes the specified additives and tobacco although in every instance the compound need not be admixed with the tobacco as above specifically described.

Those modifications and equivalents which fall within the spirit of the invention are to be considered a part thereof.

What is claimed is:

1. A tobacco product having added thereto a small amount sufficient to alter the flavor or aroma of the tobacco product of a compound having the following formula:

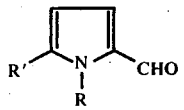

wherein R is a carboxyalkyl group containing from 2 to 8 carbon atoms and R' is hydrogen or an alkyl group of 1 to 4 carbon atoms.

2. The product recited in claim 1 wherein the amount of said compound added to the product is between about 0.0005 and about 1.0 percent by weight of the product.

3. A process for improving the flavor of tobacco which comprises adding thereto a small amount sufficient to alter the flavor or aroma of the tobacco of a compound having the formula:

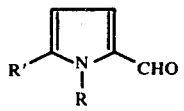

wherein R is a carboxyalkyl group containing from 2 to 8 carbon atoms and R' is hydrogen or an alkyl group of 1 to 4 carbon atoms.

4. The process of claim 3 wherein the compound of the said formula is added to the tobacco in an amount between about 0.0005 and about 1.0 percent by weight.

5. A process for improving the flavor of a tobacco product which comprises adding thereto a small amount sufficient to alter the flavor or aroma of the tobacco product of a compound having the following formula:

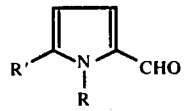

wherein R is a carboxyalkyl group containing from 2 to 8 carbon atoms and R' is hydrogen or an alkyl group of 1 to 4 carbon atoms.

* * * * *

UNITED STATES PATENT OFFICE

CERTIFICATE OF CORRECTION

PATENT NO. : 3,996,940

DATED : December 14, 1976

INVENTOR(S) : JAMES P. DICKERSON and DONALD L. ROBERTS

It is certified that error appears in the above-identified patent and that said Letters Patent are hereby corrected as shown below:

Column 1, line 42, after "of" insert -- tobacco or --

Signed and Sealed this

First Day of March 1977

[SEAL]

*Attest:*

RUTH C. MASON
*Attesting Officer*

C. MARSHALL DANN
*Commissioner of Patents and Trademarks*